US005277033A

United States Patent [19]

Sanford et al.

[11] Patent Number: 5,277,033

[45] Date of Patent: Jan. 11, 1994

[54] REFRIGERANT RECOVERY SYSTEM

[76] Inventors: Clyde E. Sanford, 7180 Hwy. 303 NE.; James D. Maxey, 7365 Aegean Blvd., both of Bremerton, Wash. 98310

[21] Appl. No.: 807,502

[22] Filed: Dec. 16, 1991

[51] Int. Cl.[5] ..... F25B 45/00

[52] U.S. Cl. ..... 62/149; 62/292; 62/475

[58] Field of Search ..... 62/77, 85, 149, 292, 62/475, 195

[56] References Cited

U.S. PATENT DOCUMENTS

| | | | |
|---|---|---|---|
| 4,539,817 | 9/1985 | Staggs et al. | 62/149 |
| 4,805,416 | 2/1989 | Mauy et al. | 62/292 |
| 4,998,413 | 3/1991 | Sato et al. | 62/149 |
| 5,123,252 | 6/1992 | Morgan, Sr. | 62/149 |

*Primary Examiner*—John M. Sollecito

*Attorney, Agent, or Firm*—Harry M. Cross, Jr.

[57] ABSTRACT

A self contained mobile refrigerant recovery and purification system in which refrigerant is withdrawn through a filter/dryer in liquid or vapor phase and then to a holding tank through a heat exchanger located within the tank. The flow of the recovered refrigerant through the heat exchanger is utilized to regulate the pressure within the tank, reducing the pressure to effect withdrawal and elevating the pressure to effect recharging of the serviced refrigeration system. After refrigerant withdrawal is complete, liquid refrigerant within the holding tank is cycled from the holding tank through the filter/dryer and back to the holding tank. The reclaimed refrigerant can then be transferred back to the serviced system in either liquid or vapor form as desired. Between recovery jobs the recovery system can be cleansed out by cycling a cleansed and pumped out by cycling a clean refrigerant through the filter/dryer and the holding tank.

4 Claims, 8 Drawing Sheets

REFRIGERANT RECOVERY SYSTEM

FIELD OF THE INVENTION

This invention relates to a refrigerant recovery system for servicing refrigeration systems. More particularly, the invention relates to recovery systems intended to remove, reclaim and recharge the refrigerant to a refrigeration system from which the refrigerant must be removed during servicing.

BACKGROUND OF THE INVENTION

It is well known that the dumping of presently used refrigerants, which consist of chlorofluorocarbons (CFC's), is extremely damaging to the environment due to the deleterious effect of CFC's on the ozone layer. With world-wide regulation of CFC production and release to the atmosphere, industry and government are looking for ways to save and reclaim CFC refrigerants.

Presently there is no practical method for removing and reclaiming CFC refrigerants from large commercial and industrial refrigeration systems when these systems undergo servicing. The recovery systems that are available seem most suited for the automotive air conditioning and home appliance trade.

SUMMARY OF THE INVENTION

It is a primary objective of the present invention to provide a mobil refrigerant removal and reclamation system that can be used in servicing large scale commercial and industrial refrigeration systems. These refrigeration systems are of the type that employ a compressible refrigerant, of which FREON is a typical example, which effects cooling when expanded and converted from a liquid to a vapor phase. Such refrigerants include the chloroflourocarbons (CFC's) and other compressible refrigeration fluids which function similarly. Another object is to provide a refrigerant recovery system that can remove and recover both liquid and gaseous refrigerants and can recharge the refrigeration system undergoing service with either liquid or gaseous refrigerant.

The system of this invention is self-contained and mobile. Refrigerant, such as CFC, is withdrawn in either liquid or gaseous phase from a refrigeration system, and transferred through filter and dryer means to liquid refrigerant holding means. After the refrigerant withdrawal is complete, liquid refrigerant within the liquid refrigerant holding means is cycled from the holding means, through the filter and dryer means, and back to the holding means on a continuous or semi-continuous basis, while the refrigeration system undergoes servicing. When the refrigeration system is ready for recharging, reclaimed refrigerant from the holding means is transferred back into the refrigeration system, in either the liquid or gaseous phase as desired. Between recovery jobs, the system of this invention can be cleansed and pumped-out by cycling a clean refrigerant through the filter and dryer means and the holding means.

DETAILED DESCRIPTION OF THE INVENTION

Figure 1:
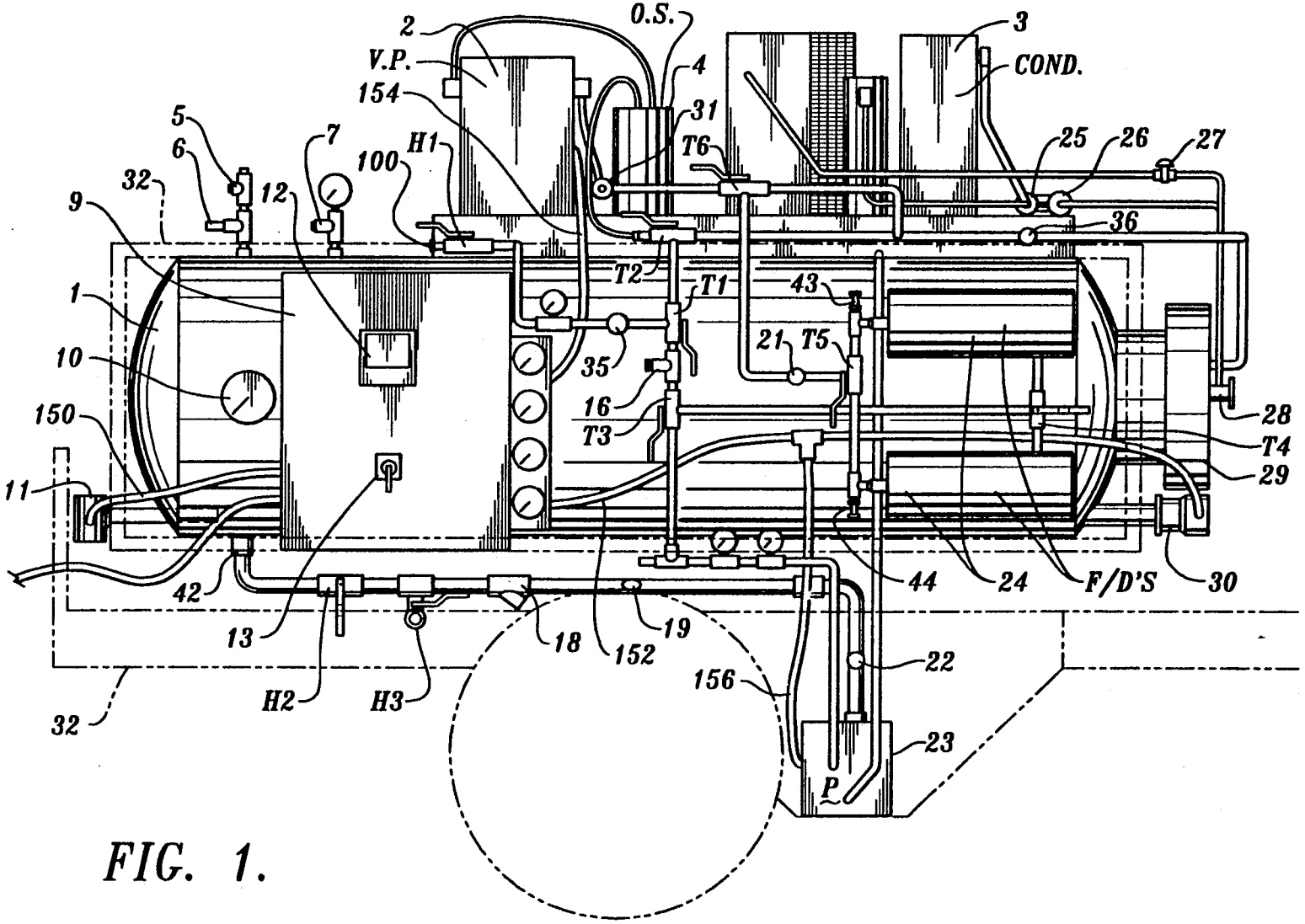
FIG. 1 is a side elevation view of the FIG. 1 system.
Figure 2:
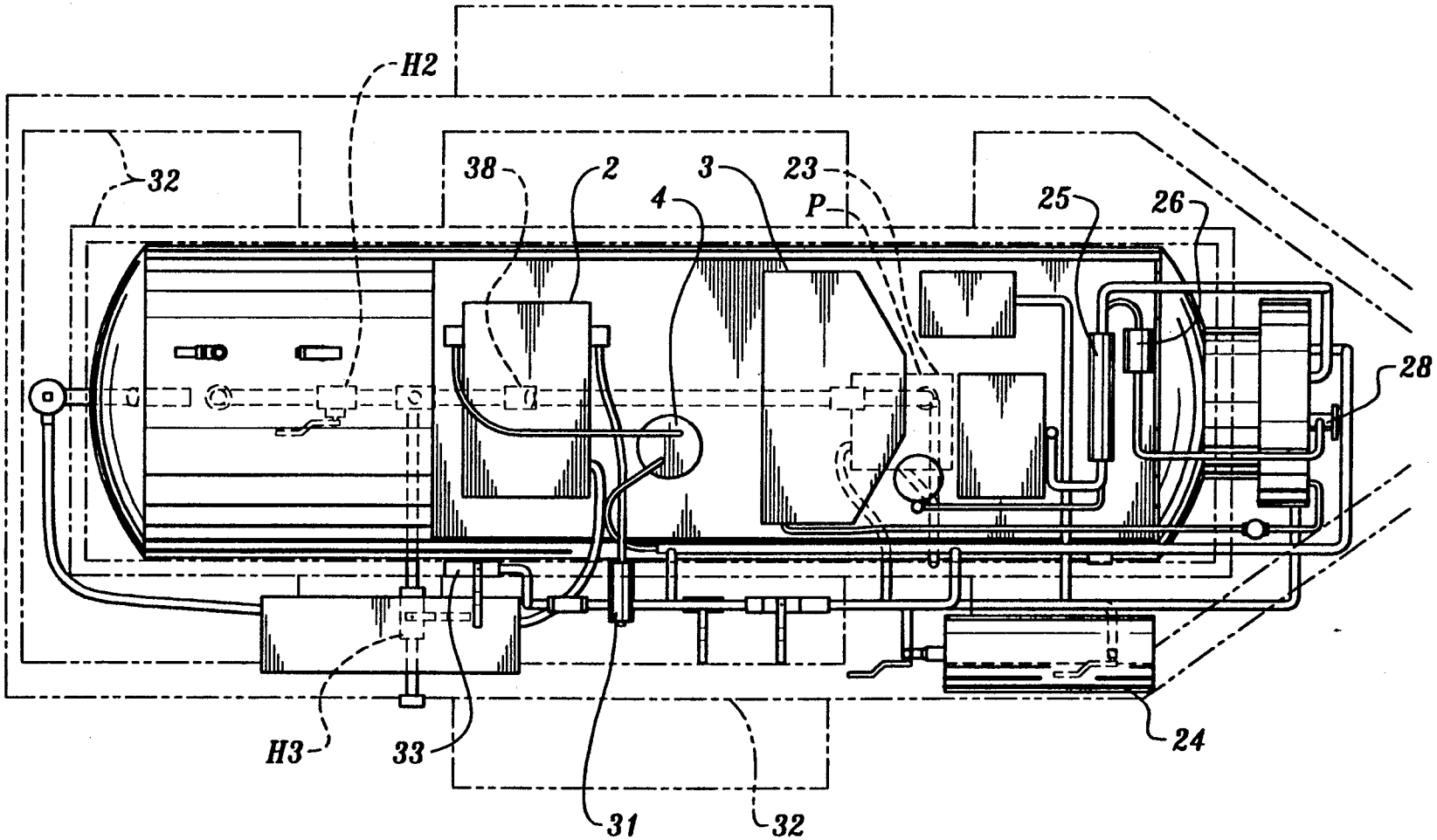
FIG. 2 is a top plan view of the FIG. 1 system.
Figure 3:
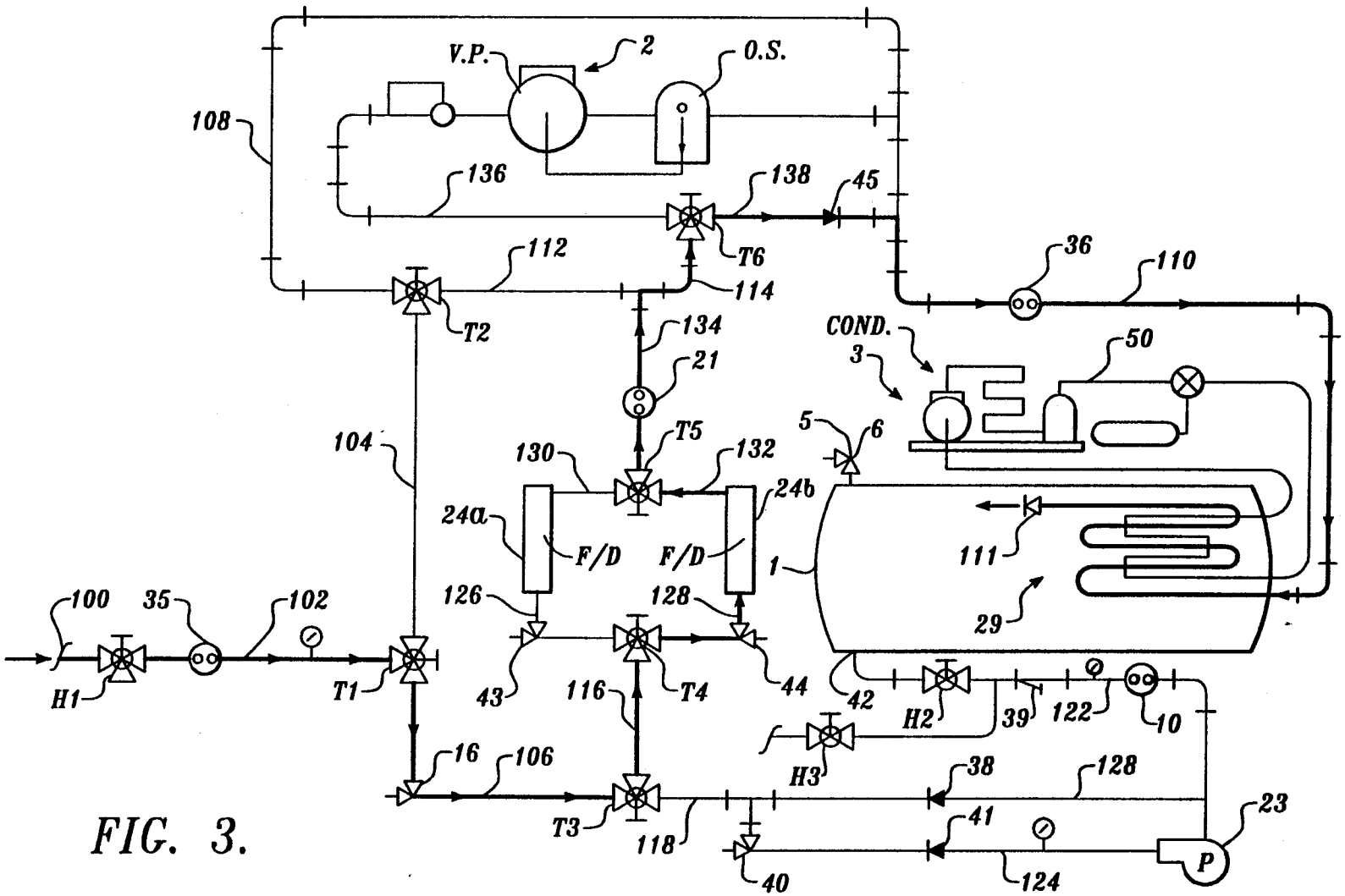
FIG. 3 is a flow diagram illustrating the operation of the system of this invention during liquid transfer from a refrigeration system.

With respect to FIGS. 1–3, the system of this invention comprises a liquid refrigerant holding tank 1, a vapor pump 2, condensing unit 3, an oil separator 4, a liquid refrigerant pump 23, a filter-dryer unit 24, and a tank-mounted heat exchanger 29, all mounted on a trailer frame 32 along with associated piping and valving. The associated valving comprises 3-way manual directional control ball valves T1–T6, 2-way manual control ball valves H1–H3, moisture indicators 19, 21, 35, and 36, relief valves 6, 16 and others as shown by a similar symbol, and pressure gauges as shown.

Control valve H1 connects the system to a refrigeration system through an appropriate coupling element 100 in line 102 leading to 3-way valve T1. Valve T1 connects to either 3-way valve T2 through line 104 or to 3-way valve T3 through line 106 and relief valve 16. Valve T3 connects to either the inlet to heat exchanger 29 through lines 108 and 110 or 3-way valve T6 through lines 112 and 114. Valve T2 connects to either 3-way valve T4 through line 116 or either: (a) to control valve H2 through lines 118, 120 (containing check valve 38) and line 122 (containing strainer 39) or b) to the output of liquid pump 23 through line 118 and line 124 (containing relief valve 40 and check valve 41); the input of liquid pump 23 being connected to control valve H2 through line 122. Control valve H2 connects to the liquid outlet 42 of tank 1. Valve T4 connects to the inlets of either filter/dryer **24*a* through line 126 (containing relief valve 43) or filter/dryer 24*b* through line 128 (containing relief valve 44). Valve T5 connects to the outlets of either filter/dryer 24 a through line 130 or filter/dryer 24*b* through line 132, and also connects to either 3-way valve T2 through lines 134 and 112 or 3-way valve T6 through lines 134 and 114. Valve T6 connects to either vapor pump 2 and oil separator 4 through line 136 or the inlet to heat exchanger 29 through lines 138 (containing check valve 45) and 110. Condenser unit 3 is also coupled to heat exchanger 29 in a closed-loop cooling coil 50 to provide a closed-loop cooling sub-system for cooling the interior of tank i and to cool incoming refrigerant from line 110**.

Heat exchanger 29 is located within the interior of tank 1. Heat exchanger 29 is a tube-in-tube heat exchanger with the inner tube communicating with line 110 and the outer tube communicating with line 50. The inner tube thereof is part of the closed-loop cooling subsystem. The outlet 111 to the inner tube of heat exchanger 29 opens into the interior of tank i as shown. Heat exchanger 29 is double-acting in the sense that the operation of condenser unit 3 will effect cooling of refrigerant passing from line 110 into the tank 1 and, concurrently, will effect cooling of the interior atmosphere of tank 1 since heat transfer will be effected within the tube-in-tube device and also between the outer tube and the tank atmosphere. Furthermore, even when no refrigerant is being transferred through line 110 and into tank 1, operation of condenser unit 3 will effect cooling of the interior atmosphere of tank 1. This interior cooling may be desired as a preliminary step to introducing reclaimed refrigerant through line 110 or it may be desired to maintain the tank 1 interior atmosphere at a desired temperature or pressure level when the system is maintained in a stand-by mode, with or without reclaimed refrigerant being held within tank 1. Condenser unit 3 can be operated to pre-cool the interior of tank 1 to effect a low enough temperature and pressure level to provide a motive force for liquid refrigerant transfer from a refrigeration system to-be-serviced without resort to a mechanical pumping system. Furthermore, when refrigerant is to be transferred back out of tank 1 to an external refrigeration system's reservoir, condenser unit 3 can be regulated to effect an increase in the atmospheric pressure within tank 1 so as to effect the refrigerant transfer without resort to a mechanical pumping system.

When liquid refrigerant of a refrigeration system, to-be-serviced, is to be transferred into the system of this invention, as shown in FIG. 3 the external refrigeration system's refrigerant port is coupled to the inlet coupling 100, and the cooling sub-system 3 may be operated to cool the interior of the refrigerant-receiving tank 1. Valves T1 and T3 are turned to communicate with the filter/dryer elements 24*a* or 24*b*, as directed by valve T4, and valves T5 and T6 are turned to communicate with the inlet to heat exchanger 29 so that the flow path will be as shown in heavy lines in FIG. 3. Then control valve H1 is opened to permit the transfer to take place.

Figure 4:
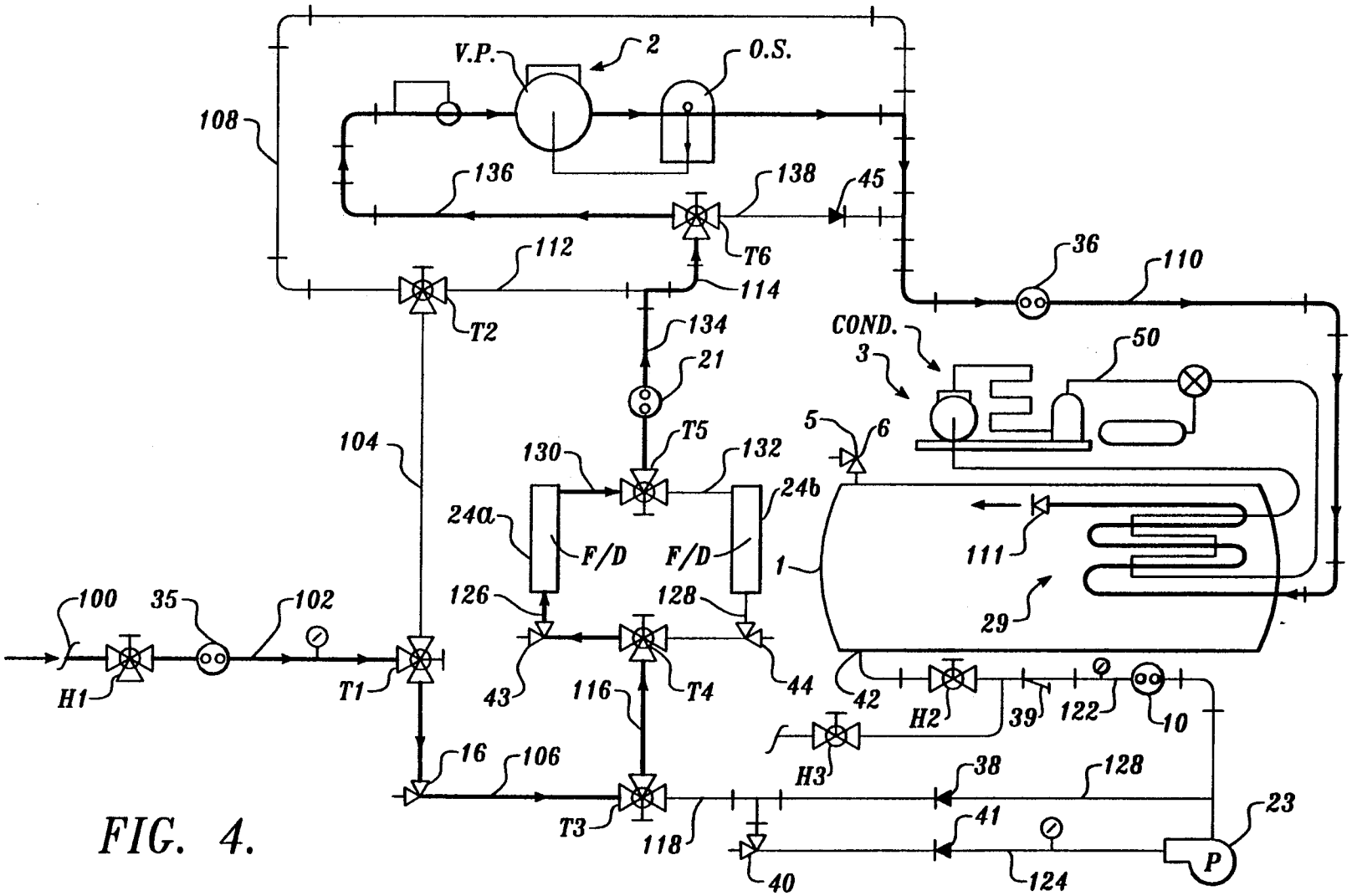
FIG. 4 is a flow diagram illustrating the operation of the system of this invention during vapor transfer from a refrigeration system.

When vapor refrigerant of a refrigeration system, to-be-serviced, is to be transferred into the system of this invention, as shown in FIG. 4 the external refrigeration system's refrigerant port is coupled to the inlet coupling 100, the cooling sub-system 3 may be operated to cool the interior of the refrigerant-receiving tank 1, and the vapor pump 2 is turned on. Valves T1 and T3 are turned to communicate with the filter/dryer elements 24*a* or 24*b*, as directed by valve T4, and valves T5 and T6 are turned to communicate with the inlet to vapor pump 2 so that the flow path will be as shown in heavy lines in FIG. 4, the vapor from the external refrigeration system being converted to liquid and entering tank 1 as a liquid.

Figure 5:
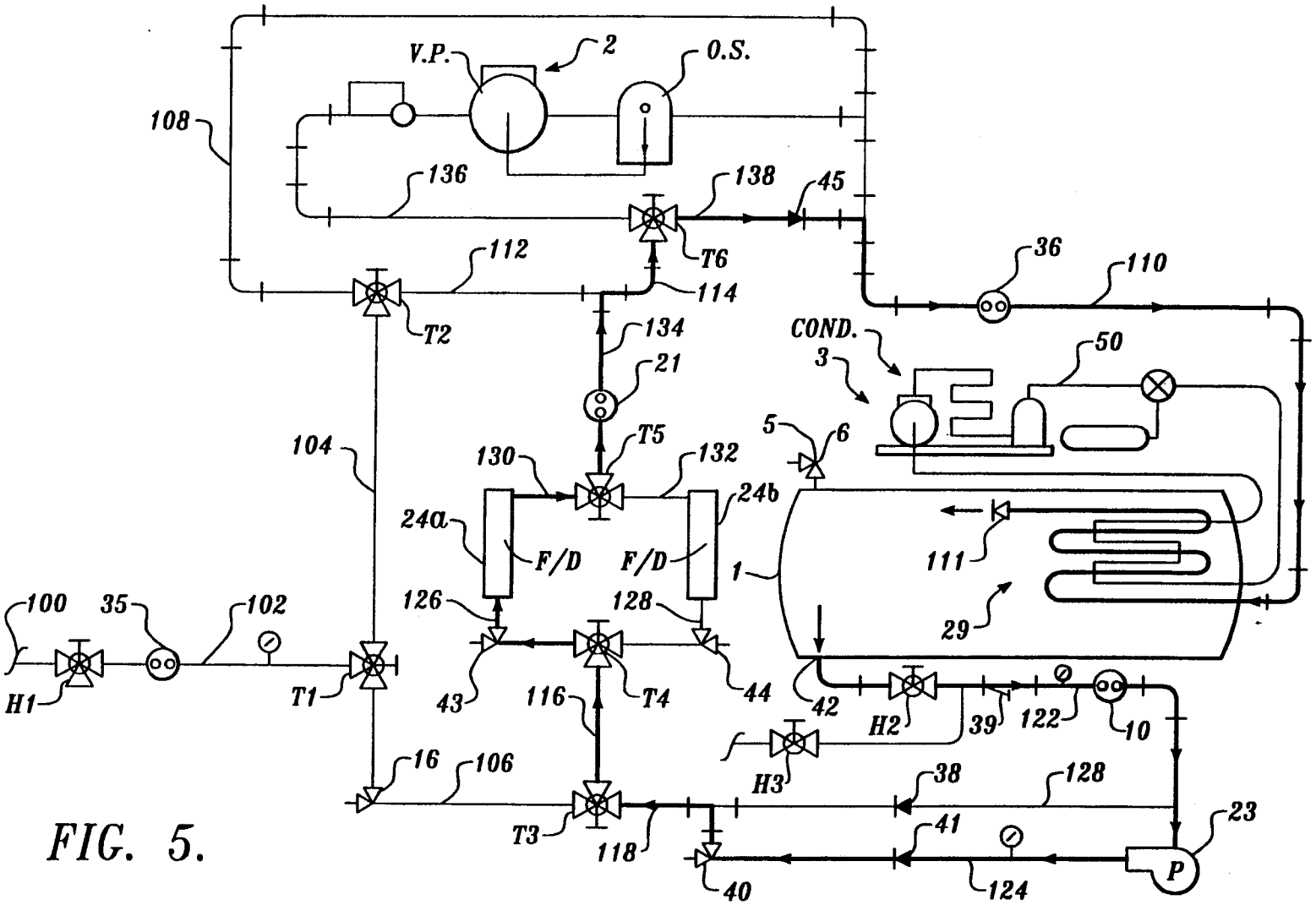
FIG. 5 is a flow diagram illustrating the operation of the system of this invention during filtering and recirculation.

After all of the refrigerant has been removed from the external system, control valve H1 is closed. Valves T3–T6 are turned to establish the flow path shown in heavy lines in FIG. 5. Control valve H2 is opened and pump 23 is turned on to permit liquid refrigerant in tank 1 to circulate through either filter 24*a* or 24*b*, as directed by valve T4, to clean and de-water the received refrigerant continuously or semi-continuously as desired while the external refrigeration system is being serviced.

Figure 6:
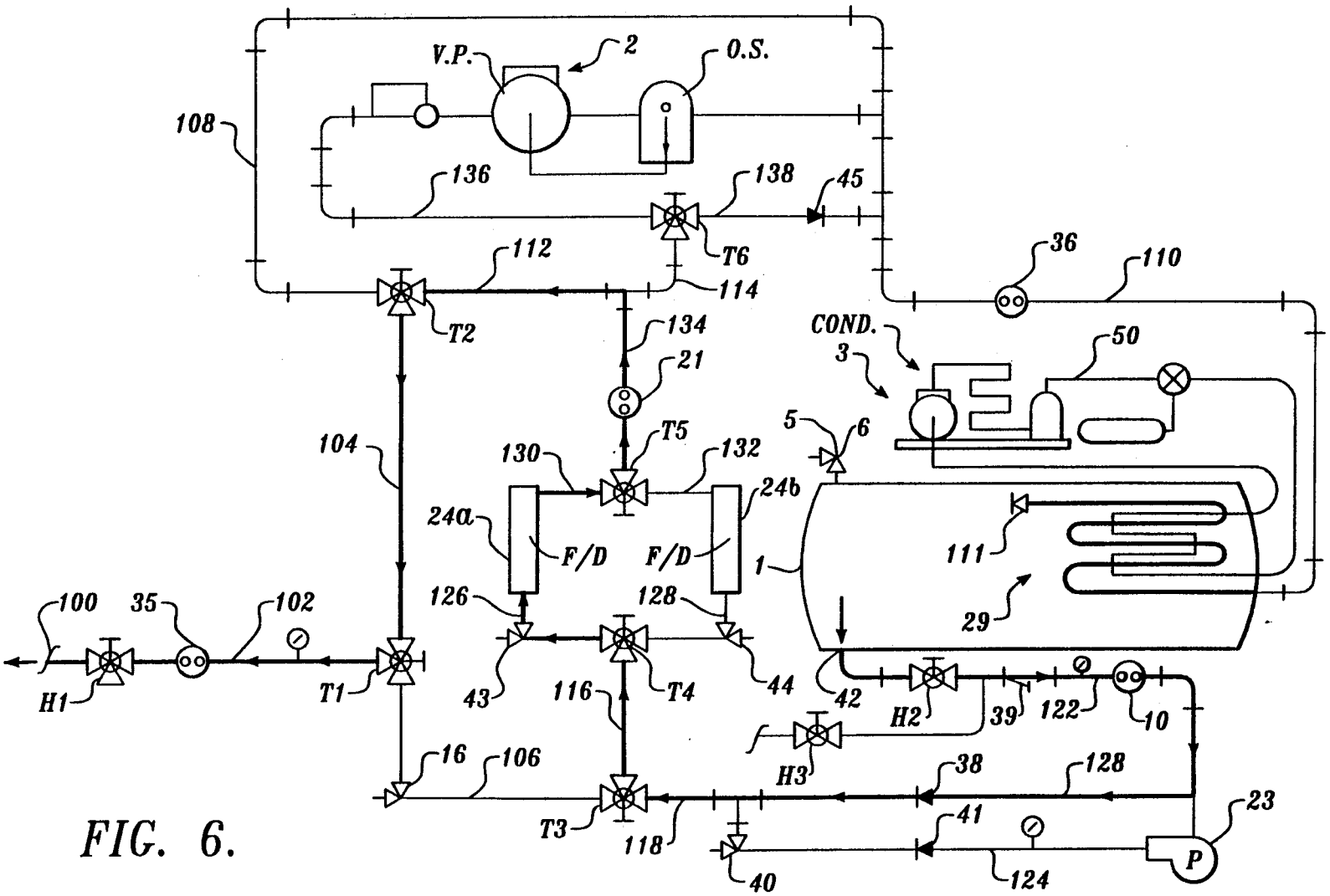
FIG. 6 is a flow diagram illustrating the operation of the system of this invention during liquid recharge to a refrigeration system.

When external refrigeration system servicing is completed, clean liquid refrigerant from tank 1 may be recharged back into the external system through valves T3, T4, T2 and H1 as shown in heavy lines in FIG. 6, through either filter/dryer 24*a* or 24*b* as directed by valve T4, upon the opening of control valve H2.

Figure 7:
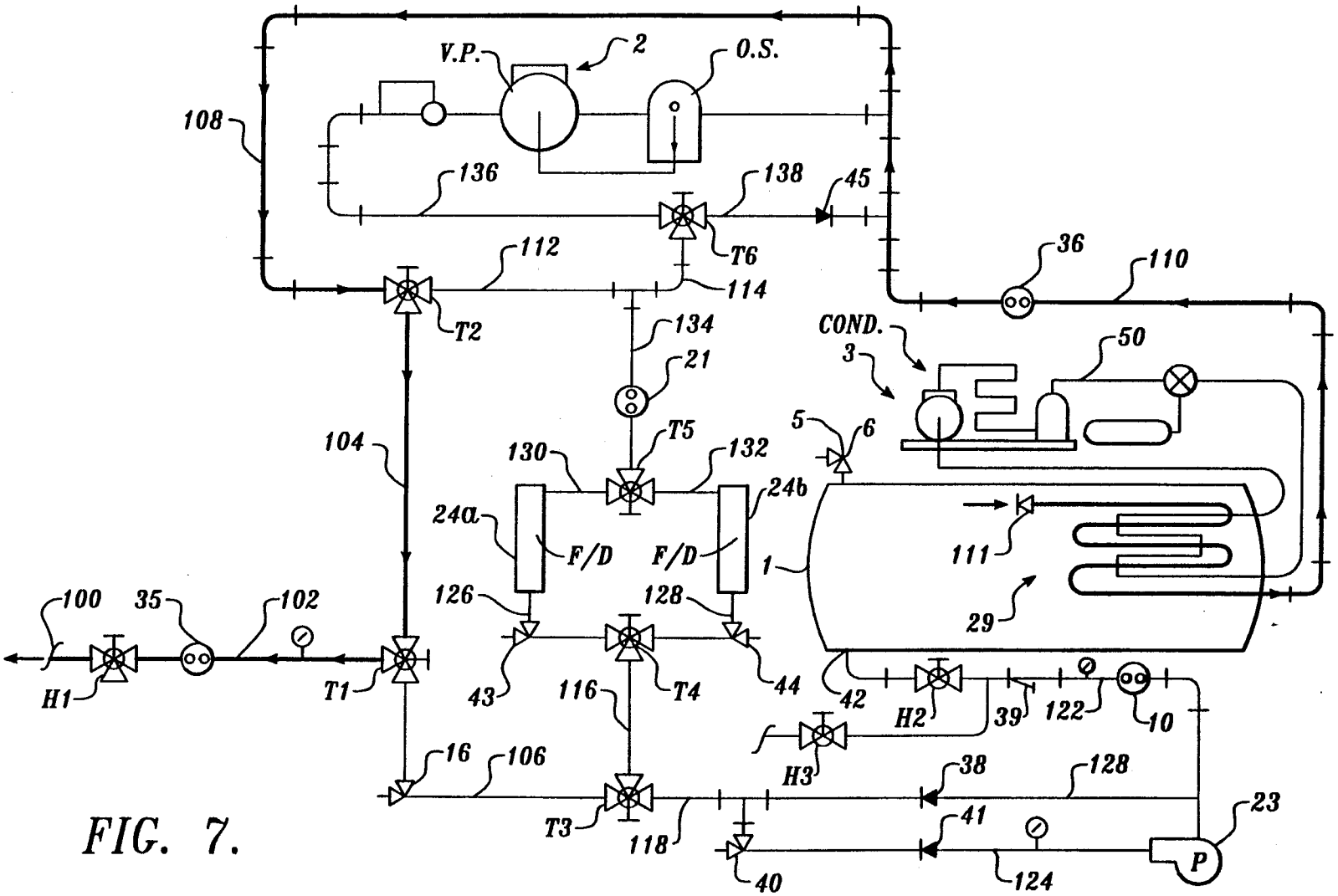
FIG. 7 is a flow diagram illustrating the operation of the system of this invention during vapor recharge to a refrigeration system.
Figure 8:
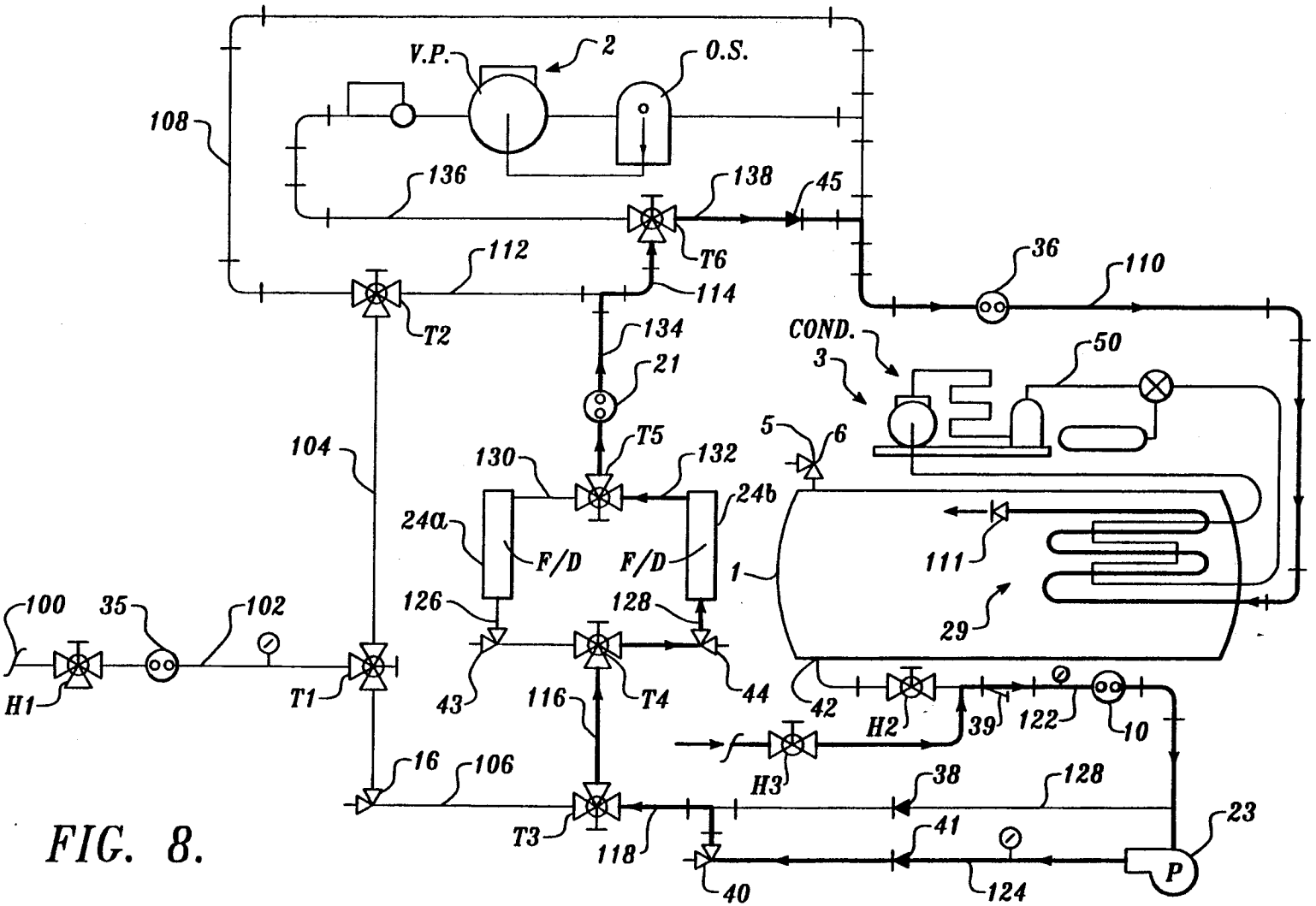
FIG. 8 is a flow diagram illustrating the operation of the system of this invention during system pump-out.

If refrigerant recharging is to be in the vapor phase, valves T2 and T1 would be turned to establish the flow path shown in heavy lines in FIG. 7 when control valve H1 is opened, With control valve H2 being closed.

Filter/dryers 24*a* and 24*b* are designed to contain replaceable filter cartridges. Therefore, valves T4 and T5 permit directing refrigerant through one or the other so that the system can operate even though one or the other filter cartridge is being replaced or serviced, or even when it is too contaminated to use further. As seen from FIGS. 1–3, the filter/dryer pair is positioned on the side of the tank 1 in an easily-accessible location. Thus, the system can be operated to transfer or recirculate and filter refrigerant even while one of the filter/dryers is opened and cleaned.

An electronic control panel 9, including a digital temperature controller 12 and a rotary cam on/off switch 13, is mounted to the side of the tank 1 and power cables (150) to the control panel and (152, 154, 156) to the various electrically-operated elements are provided to power the system.

While the preferred embodiment of the invention has been described herein, variations in the design may be made. The scope of the invention, therefore, is only to be limited by the claims appended hereto.

The embodiments of the invention in which an exclusive property is claimed are defined as follows:

I claim:

1. A refrigerant recovery system for recovery and reclamation of compressible refrigerant fluids which comprises means for connecting to an external refrigeration system to withdraw compressible refrigerant fluid therefrom; filter/drying means for filtering and drying withdrawn compressible refrigerant fluid in either liquid or vapor phase; storage means for storing withdrawn compressible refrigerant fluid in liquid phase; means for circulating withdrawn compressible refrigerant fluid between said storage means and said filter/drying means to effect cleaning and drying of said compressible refrigerant fluid in liquid phase after the compressible refrigerant fluid has been withdrawn from an external refrigeration system; and cooling means for regulating the pressure within said storage means including a heat exchanger located within said storage means and so constructed that said compressible refrigerant fluid passes therethrough when being transferred into said storage means in either liquid or vapor phase whereby said pressure can be reduced to effect withdrawal of said compressible refrigerant fluid from an external refrigeration system in liquid phase and whereby said pressure can be elevated to effect transfer of said compressible refrigerant fluid from said storage means back to an external refrigeration system.

2. A refrigerant recovery system for recovery and reclamation of compressible refrigerant fluids which comprises means for connecting to an external refrigeration system to withdraw compressible refrigerant fluid therefrom; filter/drying means for filtering and drying withdrawn compressible refrigerant fluid in either liquid or vapor phase; storage means for storing withdrawn compressible refrigerant fluid in liquid phase; means for circulating withdrawn compressible refrigerant fluid between said storage means and said filter/drying means to effect cleaning and drying of compressible refrigerant fluid in liquid phase after the compressible refrigerant fluid has been withdrawn from an external refrigeration system; and cooling means for regulating the pressure within said storage means including a heat exchanger located within said storage means and so constructed that said compressible refrigerant fluid passes therethrough when being transferred into said storage means in either liquid or vapor phase whereby said pressure can be reduced to effect withdrawal of said compressible refrigerant fluid from an external refrigeration system in liquid phase and whereby said pressure can be elevated to effect transfer of said compressible refrigerant fluid from said storage means back to an external refrigeration system; and including vapor withdrawal means for withdrawing said compressible refrigerant fluid from an external refrigeration system in vapor phase and causing the transfer of the withdrawn vapor phase refrigerant through said heat exchanger into said storage means; and wherein said cooling means includes control means to effect a conversion of vapor phase refrigerant to liquid phase within said heat exchanger whereby stored compressible refrigerant within said storage means is substantially maintained in liquid phase.

3. The system of claim 1 wherein the heat exchanger of said cooling means is provided in a tube-in-tube configuration and so connected in fluid communication with the said means for circulating withdrawn said compressible refrigerant fluid that liquid phase compressible refrigerant may be circulated from said storage means and through said heat exchanger to affect the temperature within the interior of said storage means whereby the temperature and pressure within said storage means may be regulated.

4. A refrigerant recovery system for recovery and reclamation of compressible refrigerant fluids which comprises means for connecting to an external refrigeration system to withdraw compressible refrigerant fluid therefrom; filter/drying means for filtering and drying withdrawn compressible refrigerant fluid in either liquid or vapor phase; storage means for storing withdrawn compressible refrigerant fluid in liquid phase; means for circulating withdrawn compressible refrigerant fluid between said storage means and said filter/drying means to effect cleaning and drying of said compressible refrigerant fluid in liquid phase after the compressible refrigerant fluid has been withdrawn from an external refrigeration system; cooling means for regulating the pressure within said storage means including a heat exchanger located within said storage means and so constructed that said compressible refrigerant fluid passes therethrough when being transferred into said storage means in either liquid or vapor phase whereby said pressure can be reduced to effect withdrawal of said compressible refrigerant fluid from an external refrigeration system in liquid phase and whereby said pressure can be elevated to effect transfer of said compressible refrigerant fluid from said storage means back to an external refrigeration system; vapor withdrawal means for withdrawing said compressible refrigerant fluid from an external refrigeration system in vapor phase and causing the transfer of said the withdrawn vapor phase refrigerant through said heat exchanger into said storage means; and wherein said cooling means includes control means to effect a conversion of vapor phase refrigerant to liquid phase within said heat exchanger whereby stored compressible refrigerant within said storage means is substantially maintained in liquid phase; the heat exchanger of said cooling means is provided in a tube-in-tube configuration and so connected in fluid communication with the said means for circulating withdrawn said compressible refrigerant fluid that liquid phase compressible refrigerant may be circulated from said storage means and through said heat exchanger to affect the temperature within the interior of said storage means whereby the temperature and pressure within said storage means may be regulated.

* * * * *